US011466399B2

(12) United States Patent
Bunekar et al.

(10) Patent No.: US 11,466,399 B2
(45) Date of Patent: Oct. 11, 2022

(54) ARTICLE WITH SUPER-HYDROPHOBIC SURFACE AND PREPARATION METHOD THEREOF

(71) Applicant: BenQ Materials Corporation, Taoyuan (TW)

(72) Inventors: Naveen Bunekar, Taoyuan (TW); Ju-Hui Huang, Taoyuan (TW)

(73) Assignee: BENQ MATERIALS CORPORATION, Taoyuan (TW)

( * ) Notice: Subject to any disclaimer, the term of this patent is extended or adjusted under 35 U.S.C. 154(b) by 12 days.

(21) Appl. No.: 17/129,984

(22) Filed: Dec. 22, 2020

(65) Prior Publication Data

US 2022/0195659 A1 Jun. 23, 2022

(51) Int. Cl.
*D06M 15/564* (2006.01)
*D06M 101/32* (2006.01)

(52) U.S. Cl.
CPC ..... *D06M 15/564* (2013.01); *D06M 2101/32* (2013.01); *D06M 2200/12* (2013.01)

(58) Field of Classification Search
None
See application file for complete search history.

(56) References Cited

FOREIGN PATENT DOCUMENTS

CN 102965910 B 12/2014
CN 103938431 B 1/2016

OTHER PUBLICATIONS https://patents.google.com/patent/CN102965910A/en?oq=cn102965910 (Year: 2012).*
https://patents.google.com/patent/CN103938431A/en?oq=cn103938431 (Year: 2014).*
https://products-re.evonik.com/www2/uploads/productfinder/Dynasylan-9116-EN.pdf (Year: 2021).*

* cited by examiner

*Primary Examiner* — Arti Singh-Pandey

(57) ABSTRACT

The invention is to provide an article with a super-hydrophobic surface and a method for preparing the same. The article with a super-hydrophobic surface provided by in situ formation of a plurality of hexadecyl trimethoxy silane modified Mg—Al layered double hydroxides on the surface of the article. The water contact angle of the article is not less than 130°.

8 Claims, No Drawings

ARTICLE WITH SUPER-HYDROPHOBIC SURFACE AND PREPARATION METHOD THEREOF

BACKGROUND

Technical Field

The present invention relates to an article with a super-hydrophobic surface and a method for preparing the same. More particularly, the present invention relates to an article with a super-hydrophobic surface and a method for preparing the article with a super-hydrophobic surface which has a high hydrophobicity, a desired water repellency and a great washing durability.

Description of Related Art

In recent years, there has been increased interest in the research and production of highly hydrophobic articles due to their unique characteristics such as wetting, self-cleaning, anti-contamination and anti-sticking. It is known that wetting behavior of a solid surface is controlled by geometric structure as well as chemical composition of the material. Recently, scope of wettability research has been expanded to the fabrication of super-hydrophobic surfaces with other functionalities to be used in advanced materials. In this regard, some articles having super-hydrophobic surface with multifunctional properties have been prepared by new methodologies. For example, cellulose fibers were functionalized with different ethyl-cyanoacrylate nanocomposite shells comprising submicrometer wax or polytetrafluoroethylene particles for super-hydrophobicity, $MnFe_2O_4$ nanoparticles for magnetic activity, CdSe/ZnS quantum dots for light emission, or silver nanoparticles (AgNPs) for antibacterial activity; obtaining a good self-cleaning and antimicrobial article by coatings Pt, Au or AgNPs on the surface of the article. However, the above mentioned methods have drawbacks such as high cost of coating materials or complex coating techniques such as plasma treatment or Radio Frequency (RF) sputtering.

The application of layered double hydroxide (LDH) materials on the surface of an article, such as fabric or textile, has been proposed in the state of the art to improve the hydrophobicity. The layered double hydroxide (LDH) can be formed by the methods of, such as hydrolysis, coprecipitation, reconstruction, anion-exchange reactions, urea methods, sol-gel techniques, microwave, ultrasound or hydrothermal procedures. However, the approaches mentioned above methods have disadvantages of high reaction temperature and pressure, which will lower the capacity of textile or weak the textiles structure and be not environmental friendly. In addition, the hydrophobicity of the articles with layered double hydroxide formed on the surface of the articles will decrease after washing due to the poor washing durability. Thus, the known articles with layered double hydroxide formed on the surface of the articles are not suggested to be used on durable textile applications.

Therefore, an object of the present invention is to provide an article with super-hydrophobic surface and method for treating a surface of an article with super-hydrophobicity.

SUMMARY

The present invention provides an article with a super-hydrophobic surface and a method for preparing the same. The article with a super-hydrophobic surface has a high hydrophobicity, a desired water repellency and a great washing durability. The present article with a super-hydrophobic surface provided by in situ formation of a plurality of hexadecyl trimethoxy silane modified Mg—Al layered double hydroxides on the surface of the article. The hydrophobicity of the articles can be improved by in situ forming a plurality of hexadecyl trimethoxy silane modified Mg—Al layered double hydroxides on the surface of the article. Moreover, the water repellency of article with super-hydrophobic surface can still be retained after washing.

According to an aspect of the present invention, an article with a super-hydrophobic surface is provided. The present article with a super-hydrophobic surface provided by in situ formation of a plurality of hexadecyl trimethoxy silane modified Mg—Al layered double hydroxides on the surface of the article, wherein the water contact angle of the article is not less than 130°.

In an embodiment of the present invention, the diameter of each Mg—Al layered double hydroxide is in the range of 100 nm to 200 nm.

In an embodiment of the present invention, the article can be, for example, a textile, a metal or a polymer film.

According to another aspect of the present invention, a method for preparing an article with a super-hydrophobic surface is provided. The method for preparing an article with a super-hydrophobic surface can comprise but not limited to the following steps of: (a) preparing a solution by mixing $Mg(NO_3)_2.6H_2O$, urea and a first solvent; (b) immersing an Al foil and an article into the solution; (c) heating the solution for a period of time for in situ forming a plurality of Mg—Al layered double hydroxides on the surface of the article; (d) preparing a modification solution by mixing $NH_4OH$, hexadecyl trimethoxy silane and a second solvent; (e) immersing the article with a plurality Mg—Al layered double hydroxides in situ formed thereon into the modification solution; (f) heating the modification solution for a period of time; and (g) drying the article with a plurality of Mg—Al layered double hydroxides in situ formed thereon.

In an embodiment of the method of the present invention, wherein the concentration of $Mg(NO_3)_2.6H_2O$ in the solution of step of (a) is in the range of 3 mM to 16 mM, and preferably in the range of 3.79 mM to 15.18 mM.

In an embodiment of the method of the present invention, wherein the concentration of urea in the solution of step of (a) is in the range of 0.5 mM to 2.2 mM, and preferably in the range of 0.53 mM to 2.14 mM, In an embodiment of the method of the present invention, wherein the first solvent of step of (a) can be, for example, noollier solvent.

In an embodiment of the method of the present invention, wherein the addition amount of the Al foil is in the range of 6 to 27 parts by weight, and preferably in the range of 6.5 to 26.34 parts by weight, relative to 100 parts by weight of the $Mg(NO_3)_2.6H_2O$ in the step of (b).

In an embodiment of the method of the present invention, wherein the solution is heated at the temperature in the range of 50° C. to 100° C. for a time in the range of 6 to 48 hours in the step of (c).

In an embodiment of the method of the present invention, wherein the concentration of $NH_4OH$ in the modification solution of step of (d) is in the range of 23 mM to 95 mM, and preferably in the range of 23.5 mM to 94 mM, In an embodiment of the method of the present invention, wherein a weight ratio of the addition amount of hexadecyl trimethoxy silane to the article can be in the range of 0.005 to 1, and preferably in the range of 0.1 to 0.5 in the step of (d).

In an embodiment of the method of the present invention, wherein the pH value of the modification solution of step of (d) is in the range of 8 to 14, and preferably in the range of 12 to 13.

In an embodiment of the method of the present invention, wherein the second solvent of step of (d) can be, for example, at least one of water, methyl alcohol and ethyl alcohol, or combinations thereof.

In an embodiment of the method of the present invention, wherein the modification solution is heated at the temperature in the range of 50° C. to 60° C. for a time in the range of 1 to 3 hours in the step of (f).

In an embodiment of the method of the present invention, wherein the article with a plurality of Mg—Al layered double hydroxides in situ formed thereon is dried at the temperature in the range of 60° C. to 80° C. for a time in the range of 2 to 6 hours in the step of (g).

In an embodiment of the method of the present invention, wherein the article can be, for example, textile, metal or polymer film.

According to another aspect of the present invention, an article with a super-hydrophobic surface is provided by in situ formation of a plurality of hexadecyl trimethoxy silane modified Mg—Al layered double hydroxides on a surface of an article by one of the above-mentioned methods.

The above and other aspects of the invention will become better understood with regard to the following detailed description of the preferred but non-limiting embodiment(s). These and other aspects of the invention will become apparent from the following description of the presently preferred embodiments. The detailed description is merely illustrative of the invention and does not limit the scope of the invention, which is defined by the appended claims and equivalents thereof. As would be obvious to one skilled in the art, many variations and modifications of the invention may be affected without departing from the spirit and scope of the novel concepts of the disclosure.

DETAILED DESCRIPTION

In the following detailed description, for purposes of explanation, numerous specific details are set forth in order to provide a thorough understanding of the disclosed embodiments. It will be apparent, however, that one or more embodiments may be practiced without these specific details.

It is apparent that departures from specific designs and methods described and shown will suggest themselves to those skilled in the art and may be used without departing from the spirit and scope of the invention. The present invention is not restricted to the particular constructions described and illustrated, but should be construed to cohere with all modifications that may fall within the scope of the appended claims.

Unless defined otherwise, all technical and scientific terms used herein have the same meaning as commonly understood by one of ordinary skill in the art to which this invention belongs. Generally, the nomenclature used herein and the laboratory procedures are well known and commonly employed in the art. Conventional methods are used for these procedures, such as those provided in the art and various general references. Where a term is provided in the singular, the inventors also contemplate the plural of that term. The nomenclature used herein and the laboratory procedures described below are those well-known and commonly employed in the art.

According to an aspect of the present invention, an article with a super-hydrophobic surface which has a high hydrophobicity, a desired water repellency and a great washing durability is provided. The water contact angle of the article of the present invention can be not less than 130°, and preferably in the range of 130° to 145°. The present article with a super-hydrophobic surface is provided by in situ formation of a plurality of hexadecyl trimethoxy silane modified Mg—Al layered double hydroxides on a surface of an article.

In an embodiment of the present invention, the Mg—Al layered double hydroxides can be in situ formed on a surface of an article by the methods of immersing an Al foil and the article into a solution containing $Mg(NO_3)_2.6H_2O$, urea and a solvent and then heating the solution for a period of time for in situ forming Mg—Al layered double hydroxides on the surface of the article, but not limited thereto.

In an embodiment of the present invention, the diameter of each Mg—Al layered double hydroxide can be in the range of 100 nm to 200 nm. Because Mg—Al layered double hydroxide with smaller diameter will not easily break during washing, so that the article can have better washing durability.

In an embodiment of the present invention, the hexadecyl trimethoxy silane modified Mg—Al layered double hydroxides in situ formed on the surface of the article are modified by immersing the article with a plurality of Mg—Al layered double hydroxides in situ formed thereon into the modification solution containing $NH_4OH$, hexadecyl trimethoxy silane and solvent.

In an embodiment of the present invention, the washing durability of the article can be increased due to the hexadecyl trimethoxy silane having methyl group and long carbon chain.

In an embodiment of the present invention, the article can be, for example, a textile, a metal or a polymer film, but not limited thereto.

The article with a super-hydrophobic surface of the present invention can be used as a durable hydrophobic textile, such as a wearable jacket, or be used in waste water treatment, such as water oil separations technology.

According to another aspect of the present invention, a method for preparing an article with a super-hydrophobic surface is provided. The present method can include but not limited to the following steps. The method for preparing an article with a super-hydrophobic surface has advantages of simple to produce and environment friendly.

Firstly, a solution is prepared by mixing $Mg(NO_3)_2.6H_2O$, urea and a first solvent. In an embodiment of the method of the present invention, the concentration of $Mg(NO_3)_2.6H_2O$ in the solution can be in the range of 3 mM to 16 mM, and preferably in the range of 3.79 mM to 15.18 mM. When the concentration of $Mg(NO_3)_2.6H_2O$ in the solution is higher than above mentioned range, the Mg—Al layered double hydroxides will highly grow or aggregate and being not homogenous. When the concentration of $Mg(NO_3)_2.6H_2O$ in the solution is lower than above mentioned range, the Mg—Al layered double hydroxides will grow insignificantly or very minute. The concentration of urea in the solution can be in the range of 0.5 mM to 2.2 mM, and preferably in the range of 0.53 mM to 2.14 mM. When the concentration of urea in the solution is higher than above mentioned range, the Mg—Al layered double hydroxides will highly grow or aggregate and being not homogenous. When the concentration of urea in the solution is lower than above mentioned range might cause the problem of reaction insignificantly.

Suitable first solvent of the solution can be, for example, noollier solvents. In an embodiment of the method of the present invention, the first solvent can be water, but not limited thereto.

Next, an Al foil and an article are immersed into the solution, and then the solution is heated for a period of time for in situ forming a plurality of Mg—Al layered double hydroxides on the surface of the article.

In an embodiment of the method of the present invention, the addition amount of the Al foil is in the range of 6 to 27 parts by weight, and preferably in the range of 6.5 to 26.34 parts by weight, relative to 100 parts by weight of the $Mg(NO_3)_2.6H_2O$.

Suitable article can be, for example, a textile, a metal or a polymer film, but not limited thereto.

In an embodiment of the method of the present invention, the solution is heated at the temperature in the range of 50° C. to 100° C. A time for heating the solution can be in the range of 6 to 48 hours. When the Al foil and the article are immersed into the solution, the time for immersing the Al foil and the article in the solution or the heating temperature is higher than above mentioned range, the Mg—Al layered double hydroxides will highly grow or aggregate and being not homogenous. When the Al foil and the article are immersed in the solution, the time for immersing the Al foil and the article are in the solution or the heating temperature is lower than above mentioned range, the reaction rate will be lower or less the growth of Mg—Al layered double hydroxides.

In an embodiment of the method of the present invention, the article with a plurality of Mg—Al layered double hydroxides in situ formed thereon can be selectively dried at the temperature in the range of 60° C. to 80° C. for a time in the range of 6 to 16 hours, after Mg—Al layered double hydroxides are in situ formed on the surface of the article.

After Mg—Al layered double hydroxides are in situ formed on the surface of the article, a modification solution is prepared by mixing $NH_4OH$, hexadecyl trimethoxy silane and a second solvent.

In an embodiment of the method of the present invention, the concentration of $NH_4OH$ in the modification solution can be in the range of 23 mM to 95 mM, and preferably in the range of 23.5 mM to 94 mM. When the concentration of $NH_4OH$ in the modification solution is higher than above mentioned range, hexadecyl trimethoxy silane will form gel or solid and affect the modified process. When the concentration of $NH_4OH$ in the modification solution is lower than above mentioned range, the reaction time will be longer.

In an embodiment of the method of the present invention, a weight ratio of the addition amount of hexadecyl trimethoxy silane in the modification solution to the addition amount of the article can be in the range of 0.005 to 1, and preferably in the range of 0.1 to 0.5. When the addition amount of hexadecyl trimethoxy silane in the modification solution is higher than above mentioned range, the surface of the article might become hard. When the addition amount of hexadecyl trimethoxy silane in the modification solution is lower than above mentioned range, the homogeneity of the hexadecyl trimethoxy silane might be affected.

In an embodiment of the method of the present invention, the pH value of the modification solution can be in the range of 8 to 14, and preferably in the range of 12 to 13. When the pH value is higher than above mentioned range, hexadecyl trimethoxy silane will form gel or solid and affect the modified process. When the pH value is lower than above mentioned range, the reaction time will be longer.

Suitable second solvent of the modification solution can be, for example, at least one of, water, methyl alcohol and ethyl alcohol, or combinations thereof, but not limited thereto.

After forming the modification solution, the article with a plurality Mg—Al layered double hydroxides in situ formed thereon is immersed into the modification solution, and then the modification solution is heated for a period of time.

In an embodiment of the method of the present invention, the modification solution is heated at the temperature in the range of 50° C. to 60° C. The time for heating the modification solution can be in the range of 1 to 3 hours. When the article with a plurality Mg—Al layered double hydroxides in situ formed thereon is immersed in the modification solution, and the time for immersing is higher than above mentioned range, the solvent might be evaporated. When the article with a plurality Mg—Al layered double hydroxides in situ formed thereon is immersed in the modification solution, and the time for immersing is lower than above mentioned range, the modified process might be affected.

Finally, the article with a plurality of Mg—Al layered double hydroxides in situ formed thereon is dried. In an embodiment of the method of the present invention, the article with a plurality of Mg—Al layered double hydroxides in situ formed thereon is dried at the temperature in the range of 60° C. to 80° C. for a time in the range of 2 to 6 hours.

According to another aspect of the present invention, an article with a super-hydrophobic surface provided by in situ formation of a plurality of hexadecyl trimethoxy silane modified Mg—Al layered double hydroxides on the surface of the article is obtained by one of the above-mentioned methods.

In an embodiment of the present invention, the article with a super-hydrophobic surface can be used as a durable hydrophobic textile or used in waste water treatment.

In comparison to the conventional method for preparing article with a super-hydrophobic surface, the method of the present invention comprises the steps of in situ forming a plurality of Mg—Al layered double hydroxides on the surface of the article, immersing the article with a plurality of Mg—Al layered double hydroxides formed thereon into the modification solution having hexadecyl trimethoxy silane, and then heating the modification solution. The method for according to this present invention is environment friendly since the chemical utilization is less and the heating temperature is lower. At the same time, the method according to this present invention has advantages of simple to produce, being scalable and can be easily adopted. The article with a super-hydrophobic surface prepared by the method of the present invention has a high hydrophobicity, a desired water repellency and a great washing durability.

The present invention will be explained in further detail with reference to the examples. However, the present invention is not limited to these examples.

EXAMPLES

Example 1

First, 4.1 g of $Mg(NO_3)_2.6H_2O$ and 0.58 g of urea were dissolved in 280 ml of water to form a solution. Then, 0.54 g of Al foil and 2.5 g of polyester textile were added into the solution and heated to 70° C. for 46 hours to in situ form a plurality of Mg—Al LDH on a surface of the polyester textile. After reaction is completed, the polyester textile with a plurality of Mg—Al LDH in situ formed thereon was washed by deionized water and dried in oven at 60° C. for 16 hours.

Next, 25 ml of ethanol, 0.75 ml of $NH_4OH$ and 0.25 g of hexadecyl trimethoxy silane (Dynasylan 9116, commercially available from Evonik Industries AG, Germany) were mixed and stirred at 50° C. for 1 hour to form a modification solution. Then, 2.5 g of the polyester textile with a plurality of Mg—Al LDH in situ formed thereon was immersed in the modification solution at 50° C. for 3 hours. After that, the polyester textile with a plurality of Mg—Al LDH in situ formed thereon was removed therefrom and dried at 60° C. for 2.5 hours to obtain a textile with a super-hydrophobic surface.

Example 2

First, 2.05 g of $Mg(NO_3)_2.6H_2O$ and 0.58 g of urea were dissolved in 280 ml of water to form a solution. Then, 0.54 g of Al foil and 2.5 g of polyester textile were added into the solution and heated to 70° C. for 46 hours to in situ form a plurality of Mg—Al LDH on a surface of the polyester textile. The polyester textile with a plurality of Mg—Al LDH in situ formed thereon was washed by deionized water and dried in oven at 60° C. for 16 hours.

Next, 25 ml of ethanol, 1.65 ml of $NH_4OH$ and 0.25 g of hexadecyl trimethoxy silane (Dynasylan 9116, commercially available from Evonik Industries AG, Germany) were mixed and stirred at 50° C. for 1 hour to form a modification solution. Then, 2.5 g of the polyester textile with a plurality of Mg—Al LDH in situ formed thereon was immersed in the modification solution at 50° C. for 3 hours. After that, the polyester textile with a plurality of Mg—Al LDH in situ formed thereon was removed therefrom and dried at 60° C. for 2.5 hours to obtain a textile with a super-hydrophobic surface.

Example 3

First, 8.2 g of $Mg(NO_3)_2.6H_2O$ and 0.58 g of urea were dissolved in 280 ml of water to form a solution. Then, 0.54 g of Al foil and 2.5 g of polyester textile were added into the solution and heated to 70° C. for 46 hours to in situ form a plurality of Mg—Al LDH on a surface of the polyester textile. The polyester textile with a plurality of Mg—Al LDH in situ formed thereon was washed by deionized water and dried in oven at 60° C. for 16 hours.

Next, 25 ml of ethanol, 1.65 ml of $NH_4OH$ and 0.25 g of hexadecyl trimethoxy silane (Dynasylan 9116, commercially available from Evonik Industries AG, Germany) were mixed and stirred at 50° C. for 1 hour to form a modification solution. Then, 2.5 g of the polyester textile with a plurality of Mg—Al LDH in situ formed thereon was immersed in the modification solution at 50° C. for 3 hours. After that, the polyester textile with a plurality of Mg—Al LDH in situ formed thereon was removed therefrom and dried at 60° C. for 2.5 hours to obtain a textile with a super-hydrophobic surface.

Example 4

First, 4.1 g of $Mg(NO_3)_2.6H_2O$ and 0.29 g of urea were dissolved in 280 ml of water to form a solution. Then, 0.54 g of Al foil and 2.5 g of polyester textile were added into the solution and heated to 70° C. for 46 hours to in situ form a plurality of Mg—Al LDH on a surface of the polyester textile. The polyester textile with a plurality of Mg—Al LDH in situ formed thereon was washed by deionized water and dried in oven at 60° C. for 16 hours.

Next, 25 ml of ethanol, 1.65 ml of $NH_4OH$ and 0.25 g of hexadecyl trimethoxy silane (Dynasylan 9116, commercially available from Evonik Industries AG, Germany) were mixed and stirred at 50° C. for 1 hour to form a modification solution. Then, 2.5 g of the polyester textile with a plurality of Mg—Al LDH in situ formed thereon was immersed in the modification solution at 50° C. for 3 hours. After that, the polyester textile with a plurality of Mg—Al LDH in situ formed thereon was removed therefrom and dried at 60° C. for 2.5 hours to obtain a textile with a super-hydrophobic surface.

Example 5

First, 4.1 g of $Mg(NO_3)_2.6H_2O$ and 0.58 g of urea were dissolved in 280 ml of water to form a solution. Then, 1 g of Al foil and 4.62 g of polyester textile were added into the solution and heated to 70° C. for 46 hours to in situ form a plurality of Mg—Al LDH on a surface of the polyester textile. The polyester textile with a plurality of Mg—Al LDH in situ formed thereon was washed by deionized water and dried in oven at 60° C. for 16 hours.

Next, 25 ml of ethanol, 1.65 ml of $NH_4OH$ and 0.25 g of hexadecyl trimethoxy silane (Dynasylan 9116, commercially available from Evonik Industries AG, Germany) were mixed and stirred at 50° C. for 1 hour to form a modification solution. Then, 2.5 g of the polyester textile with a plurality of Mg—Al LDH in situ formed thereon was immersed in the modification solution at 50° C. for 3 hours. After that, the polyester textile with a plurality of Mg—Al LDH in situ formed thereon was removed therefrom and dried at 60° C. for 2.5 hours to obtain a textile with a super-hydrophobic surface.

Comparative Example 1

First, 4.1 g of $Mg(NO_3)_2.6H_2O$ and 1.16 g of urea were dissolved in 280 ml of water to form a solution. Then, 0.54 g of Al foil and 2.5 g of polyester textile were added into the solution and heated to 70° C. for 46 hours to in situ form a plurality of Mg—Al LDH on a surface of the polyester textile. The polyester textile with a plurality of Mg—Al LDH in situ formed thereon was washed by deionized water and dried in oven at 60° C. for 16 hours.

Next, the polyester textile with a plurality of Mg—Al LDH in situ formed thereon was immersed in a sodium laurate aqueous solution having a concentration of 2 M at 25° C. for 2 hours. After that, the polyester textile with a plurality of Mg—Al LDH in situ formed thereon was removed therefrom and washed by water and ethanol. Finally, the polyester textile with a plurality of Mg—Al LDH in situ formed thereon was dried at 60° C. for 2.5 hours to obtain a textile with a super-hydrophobic surface.

Comparative Example 2

First, 4.1 g of $Mg(NO_3)_2.6H_2O$ and 0.58 g of urea were dissolved in 280 ml of water to form a solution. Then, 0.54 g of Al foil and 2.5 g of polyester textile were added into the solution and heated to 70° C. for 46 hours to in situ form a plurality of Mg—Al LDH on a surface of the polyester textile. The polyester textile with a plurality of Mg—Al LDH in situ formed thereon was washed by deionized water and dried in oven at 60° C. for 16 hours.

Next, 25 ml of ethanol, 1.67 ml of $NH_4OH$ and 0.025 g of hexadecyl trimethoxy silane (Dynasylan 9116, commercially available from Evonik Industries AG, Germany) were mixed and stirred at 50° C. for 1 hour to form a modification solution. Then, 2.5 g of the polyester textile with a plurality of Mg—Al LDH in situ formed thereon was immersed in the modification solution at 50° C. for 3 hours. After that, the polyester textile with a plurality of Mg—Al LDH was removed therefrom and dried at 60° C. for 2.5 hours to obtain a textile with a super-hydrophobic surface.

Measurement of Water Contact Angle

The water contact angle of the textile with a super-hydrophobic surface was measured by contact angle analyzer (Phoenix 150, commercially available from Surface Electro Optics Co, Korean).

The Water Repellency Test

The water repellency test was evaluated according to AATCC 22-2005. First, three 180.0×180.0 mm test specimens was cut from each textile of Examples and Comparative Examples and securely in the metal hoop with diameter of 150±5 mm, so that the face of the test specimens will be exposed to the water spray. The distance between the test specimens and the metal nozzle was 150±2 mm. Next, 250 mL of distilled water was sprayed onto the test specimens in 25 to 30 seconds by the metal nozzle. Finally, the test specimens were tapped and the wet or spotted pattern on the specimens was compared with the rating chart.

In the standard list, ISO 5 represents that no sticking or wetting of upper surface; ISO 4 represents that slight random sticking or wetting of upper surface; ISO 3 represents that wetting of upper surface at spray points; ISO 2 represents that partial wetting of whole upper surface; ISO 1 represents that complete wetting of whole of upper surface; ISO 0 complete wetting of whole upper and lower surface.

The Washing Durability Test

The textile with a super-hydrophobic surface of Examples and Comparative Examples were washed according to AATCC TM 135 standard washing for ten times. After washed, the water repellency of the textile of the Examples and Comparative Examples were evaluated according to the above mentioned method.

TABLE 1

The measurement results of Examples and Comparative

| | Example | | | | | Comparative Example | |
|---|---|---|---|---|---|---|---|
| | 1 | 2 | 3 | 4 | 5 | 1 | 2 |
| Water Contact angle (°) | 135 | 135 | 135 | 135 | 135 | 125 | 142 |
| Water repellency test (before washing) | ISO 5 | ISO 5 | ISO 5 | ISO 5 | ISO 5 | ISO 5 | ISO 3 |
| Water repellency test (after washing) | ISO 5 | ISO 5 | ISO 5 | ISO 5 | ISO 5 | ISO 0 | ISO 2 |

From the results shown in Table 1, the water contact angle of the textiles of Example 1 to Example 4 all are 135°. Therefore, the textiles of Examples 1 to Example 5 of the present invention have more excellent hydrophobicity than Comparative Example 1. In addition, the water repellency after washed of textile of Example 1 to Example 5 are ISO 5, it can be seen that the desirable hydrophobicity and water repellency of textile can still be retained. The washing durability of textiles of Comparative Example 1 and Comparative Example 2 are too low to be using as durable textile applications.

While the invention has been described by way of example(s) and in terms of the embodiments, it is to be understood that the invention is not limited thereto. On the contrary, it is intended to cover various modifications and similar arrangements and procedures, and the scope of the appended claims therefore should be accorded the broadest interpretation so as to encompass all such modifications and similar arrangements and procedures.

What is claimed is:

1. An article with a super-hydrophobic surface, comprising an article; and a plurality of hexadecyl trimethoxy silane modified Mg—Al layered double hydroxides in situ formed on a surface of the article, wherein the water contact angle of the article is not less than 130°;

wherein the diameter of each Mg—Al layered double hydroxide is in the range of 100 nm to 200 nm.

2. The article according to claim 1, wherein the article is a textile, a metal or a polymer film.

3. The article according to claim 1, wherein the article is prepared by the method comprising steps of:

(a) preparing a solution by mixing $Mg(NO_3)_2.6H_2O$, urea and a first solvent;

(b) immersing an Al foil and an article into the solution;

(c) heating the solution for a period of time for in situ forming a plurality of Mg—Al layered double hydroxides on a surface of the article;

(d) preparing a modification solution by mixing $NH_4OH$, hexadecyl trimethoxy silane and a second solvent;

(e) immersing the article with a plurality of Mg—Al layered double hydroxides in situ formed thereon into the modification solution;

(f) heating the modification solution for a period of time; and (g) drying the article with a plurality of Mg—Al layered double hydroxides in situ formed thereon.

4. The article according to claim 3, wherein the concentration of $Mg(NO_3)_2.6H_2O$ in the solution of the step of (a) is in the range of 3 mM to 16 mM.

5. The article according to claim 3, wherein the concentration of urea in the solution of the step of (a) is in the range of 0.5 mM to 2.2 mM.

6. The article according to claim 3, wherein the addition amount of the Al foil in the step of (b) is in the range of 6 to 27 parts by weight relative to 100 parts by weight of the $Mg(NO_3)_2.6H_2O$ in the step of (a).

7. The article according to claim 3, wherein the concentration of $NH_4OH$ in the modification solution of the step of (d) is in the range of 23 mM to 95 mM.

8. The article according to claim 3, wherein a weight ratio of the addition amount of hexadecyl trimethoxy silane in the modification solution to the addition amount of the article is in the range of 0.005 to 1.

* * * * *